United States Patent [19]

Rasmussen et al.

[11] Patent Number: 4,585,426

[45] Date of Patent: Apr. 29, 1986

[54] MOBILE PLAYSET

[75] Inventors: Russell G. Rasmussen, Skokie; Eugene Jaworski, Park Ridge; Howard J. Morrison, Deerfield, all of Ill.

[73] Assignee: Marvin Glass & Associates, Chicago, Ill.

[21] Appl. No.: 579,143

[22] Filed: Feb. 10, 1984

[51] Int. Cl.[4] ..... A63H 17/06; A63H 17/26; A63H 13/00

[52] U.S. Cl. ..... 446/428; 446/469; 446/279

[58] Field of Search ..... 446/424, 425, 426, 427, 446/428, 431, 432, 434, 438, 448, 449, 457, 462, 465, 466, 469, 470, 471, 88, 95, 96, 93, 94

[56] References Cited

U.S. PATENT DOCUMENTS

| | | | |
|---|---|---|---|
| 2,577,702 | 12/1951 | DeSwart | 446/96 |
| 2,870,566 | 1/1959 | Hofler | 446/434 X |
| 2,990,644 | 7/1961 | Bonanno | 446/438 |
| 3,224,137 | 12/1965 | Wright et al. | 446/94 |
| 3,574,969 | 4/1971 | Cleveland | 446/279 X |
| 3,660,927 | 5/1972 | De Christopher | 446/426 X |
| 3,691,681 | 9/1972 | Gagnon | 446/425 |
| 3,757,464 | 9/1973 | Gagnon | 446/427 |
| 3,996,692 | 12/1976 | Daenen | 446/94 |
| 4,032,295 | 6/1977 | Meyer et al. | 446/129 |
| 4,150,508 | 4/1979 | Ogawa | 446/93 X |
| 4,170,083 | 10/1979 | Freelander et al. | 446/95 |
| 4,189,864 | 2/1980 | Saito | 446/462 X |
| 4,217,724 | 8/1980 | Schoenfield et al. | 446/96 X |
| 4,274,225 | 6/1981 | Knauff et al. | 446/438 X |

FOREIGN PATENT DOCUMENTS

| | | | |
|---|---|---|---|
| 1172588 | 6/1964 | Fed. Rep. of Germany | 446/438 |
| 2310142 | 3/1976 | France | 446/428 |
| 2068751 | 8/1981 | United Kingdom | 446/470 |
| 2112656 | 7/1983 | United Kingdom | 446/462 |

*Primary Examiner*—Robert A. Hafer
*Assistant Examiner*—D. Neal Muir
*Attorney, Agent, or Firm*—John S. Pacocha

[57] ABSTRACT

A motor driven toy mobile playset has three articulated deck sections. Each section has a wheel and axle assembly powered by a battery motor driving a single drive shaft that extends through all of the sections transverse to the wheel axles. When supported upon a level playing surface the sections form a chassis having a generally planar deck. Various bores and slots are defined on the sections for removably mounting accessories. Some of the accessories are mountable within bores in the ends of the wheel axles. One accessory is driven by a power take-off. A crane boom is mountable in a number of positions including one which provides a manually operable winch with a hook and cable. The front section has a lighted bridge structure with a spotlight and an upper head lamp bar both utilizing a single light bulb connected to the battery.

18 Claims, 16 Drawing Figures

MOBILE PLAYSET

BACKGROUND OF THE INVENTION

1. Field of the Invention

This invention relates generally to toy vehicles and more particularly to toy vehicles having removable accessories and adapted for use with toy figures or other toy vehicles as mobile playsets.

2. Background Art

Toy vehicles, particularly those including various accessories designed for simulated use by toy figures are popular toys. An example of such a toy vehicle with accessories is disclosed in U.S. Pat. No. 4,032,295. There remains, however, a need for additional toy vehicles or mobile playsets which are readily adaptable by the child for play with various accessories and to accommodate various toy figures and even other toy vehicles. It would, of course, be desirable for such a toy vehicle to accommodate variations in design and dimensions of various manufacturers' toy figures.

SUMMARY OF THE INVENTION

The present invention is concerned with providing a toy vehicle that may function as a mobile playset and which has a number of accessories, is readily adaptable by the child for use and storage of various accessories, carries a number of toy figures in various static and dynamic arrangements, and even carries other toy vehicles. These and other objects and advantages of the invention are achieved by providing a relatively large chassis having a substantially flat deck with provisions for accommodating a number of removable accessories. Among the accessories are carriers for toy figures as well as simulated radar equipment, a core sampling auger, and a claw. The mobile playset is battery motor driven and has three independently swiveling axle drive assemblies. Power take-off is provided for rotating the radar equipment. A removable crane boom is mountable on various parts of the playset including adjacent the front where a thumb-wheel powered winch provides a cable and hook usable with the crane. In addition to the deck, accessories both static and dynamic are mountable upon the vehicle axles as well as the free end of the crane boom.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
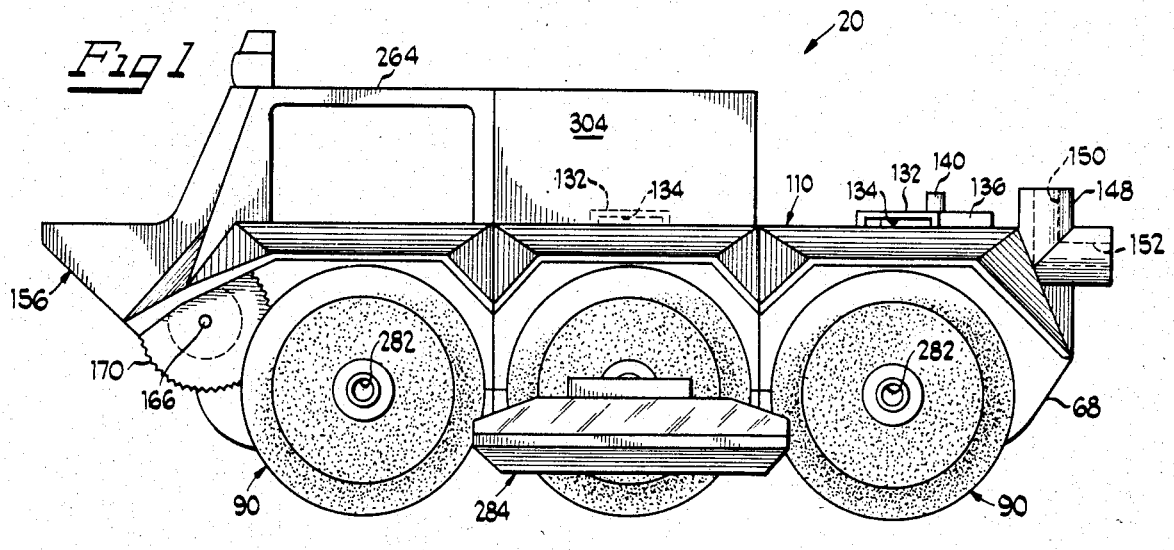
FIG. 1 is a side elevational view of an embodiment of the present invention with one of the accessories mounted on a wheel axle.
Figure 2:
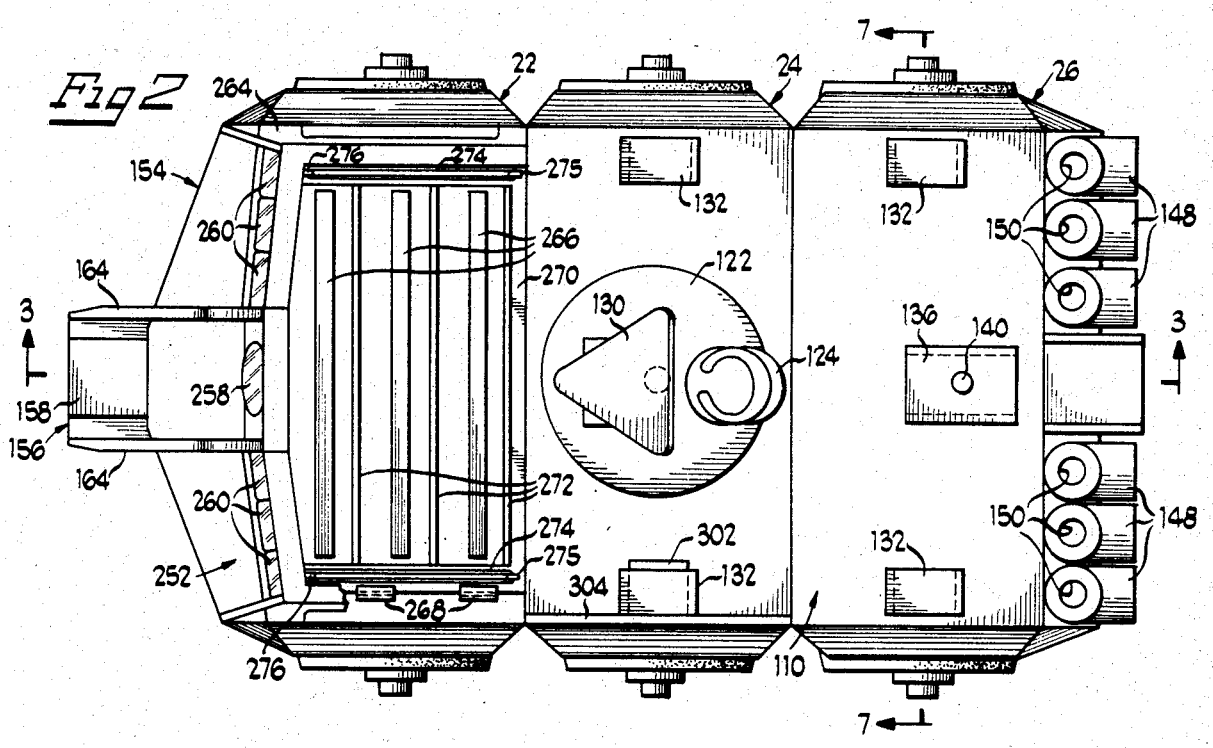
FIG. 2 is a top plan view without the mounted accessories.
Figure 9:
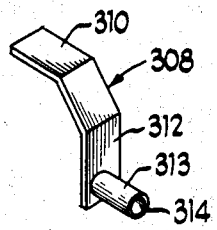
FIG. 9 is a perspective view of a transition support accessory.
Figure 10:
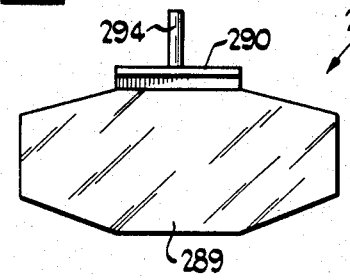
FIG. 10 is a top plan view of another accessory.
Figure 11:
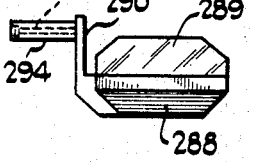
FIG. 11 is an end elevational view of the accessory shown in FIG. 10.

Referring now to the drawings in which like parts are designated by like reference characters throughout the several views, there is shown in FIG. 1 a vehicle or mobile playset 20. The vehicle of the present invention utilizes the same independent driven wheeled axle mounting of copending application Ser. No. 436,650 filed Oct. 25, 1982 now U.S. Pat. No. 4,459,776 issued July 17, 1984. However, vehicle 20 has a chassis made up of three independent sections 22, 24 and 26. Each chassis section pivots or swivels with respect to the adjoining section and carries a driven wheeled axle.

Front section 22 has a forward wall 30 and a rearward wall 32, side walls 34 and 35, bottom 36, and top 38 defining a hollow interior. Forward wall 30 includes a boss 40 directed toward the hollow interior and adapted to journal a shaft for rotation. Rearward wall 32 has a generally centrally disposed aperture 42 through which a shaft journaled in boss 40 may freely pass. Also included in the rearward wall 32, above the circular aperture 42, is an approximately 90-degree arcuate slot 44.

Center section 24 has a forward wall 46, rearward wall 48, side walls 50 and 51, bottom 52, and top 54 enclosing a hollow interior. Extending through both the forward and rearward walls are aligned circular apertures 56 and 58, respectively. The aligned openings 56 and 58 are of the same size as opening 42 of the rearward wall 32 of the front section. Disposed, substantially vertically above each of the openings, on the forward and rearward walls is an outwardly directed cylindrical pin 62 and 64, respectively.

Rear section 26 has a forward wall 66 and a rearward wall 68, which together with side walls 70 and 71, bottom 72 and top 74, define a hollow interior. The forward wall 66 has a circular aperture 76 of the same size as apertures 42, 56 and 58, and rearward wall 68 has an inwardly directed boss 78 adapted to journal a shaft for rotation similar to boss 40. Forward wall 66 also has, disposed above the circular aperture 76, an approximately 90-degree arcuate slot 80.

When the three sections are aligned and assembled, an elongated drive shaft 82 is journaled for rotation at each end in one of the bosses 40 and 78, and freely passes through the apertures 42, 56, 58 and 76. The outwardly projecting pins 62 and 64 of the center section 24 are received in the arcuate slots 44 and 80 of the front and rear sections, respectively. Thus, it will be appreciated that each of the sections may swivel around the drive shaft 82 to the limits established by the pin in the arcuate slot of the adjoining section.

Mounted on the shaft 82 at spaced intervals, for rotation with the shaft, are worms 84. Adjacent the center worm is a gear 86 that is also mounted on the shaft 82 for rotation with the shaft. Journaled for rotation in the side walls of each of the front, middle and rear sections is an axle 88 disposed transverse to and below the shaft 82. Secured to the projecting ends of each of the axles 88 for rotation with the axle is a wheel assembly 90.

Within the middle section 24, there is a motor 92 which has an output pinion 94. Through speed reducing gears 96 and 97 the output pinion drives the gear 86 and hence the shaft together with the worms 84. The speed reduction gears 96 and 97 are mounted for rotation on a shaft carried by bracket 98 which is attached to, or integrally formed with, the side wall 50 of the middle section 24. Secured for rotation on each of the axles 88, and disposed for engagement with one of the worms 84, is a worm gear 100. Thus, as each section swivels with respect to the adjacent section, the worm gear 100 remains in driving engagement with its respective worm 84.

Batteries 102 providing power for the motor 92 are mounted in spring contact clips 104 within the center section 24. Switch 106 is mounted in the bottom 52 of the center section and is connected by suitable wiring (not shown) between the battery and the motor. The on/off button 107 of the switch projects out through the bottom 52 for access.

Articulation of the three sections permits the vehicle 20 to be propelled in an interesting manner over irregular surfaces or rough terrain. The 90-degree limits effected by the cooperating pin and slot arrangements on adjoining sections prevents any one section from tipping over completely. When the vehicle 20 is on a substantially flat planar surface, the tops 38, 54 and 74 of the three sections define a generally flat horizontal deck 110.

A horizontal portion 112 of the bracket 98 carries a spindle 114 with a crown gear 116 mounted for rotation with the spindle. The crown gear 116 engages the spur gear 86 on the drive shaft 82. Spindle 114 projects through an aperture 118 in the top wall 54 and the projecting portion is keyed to rotatably drive an accessory.

Figures 3, 4, 8:
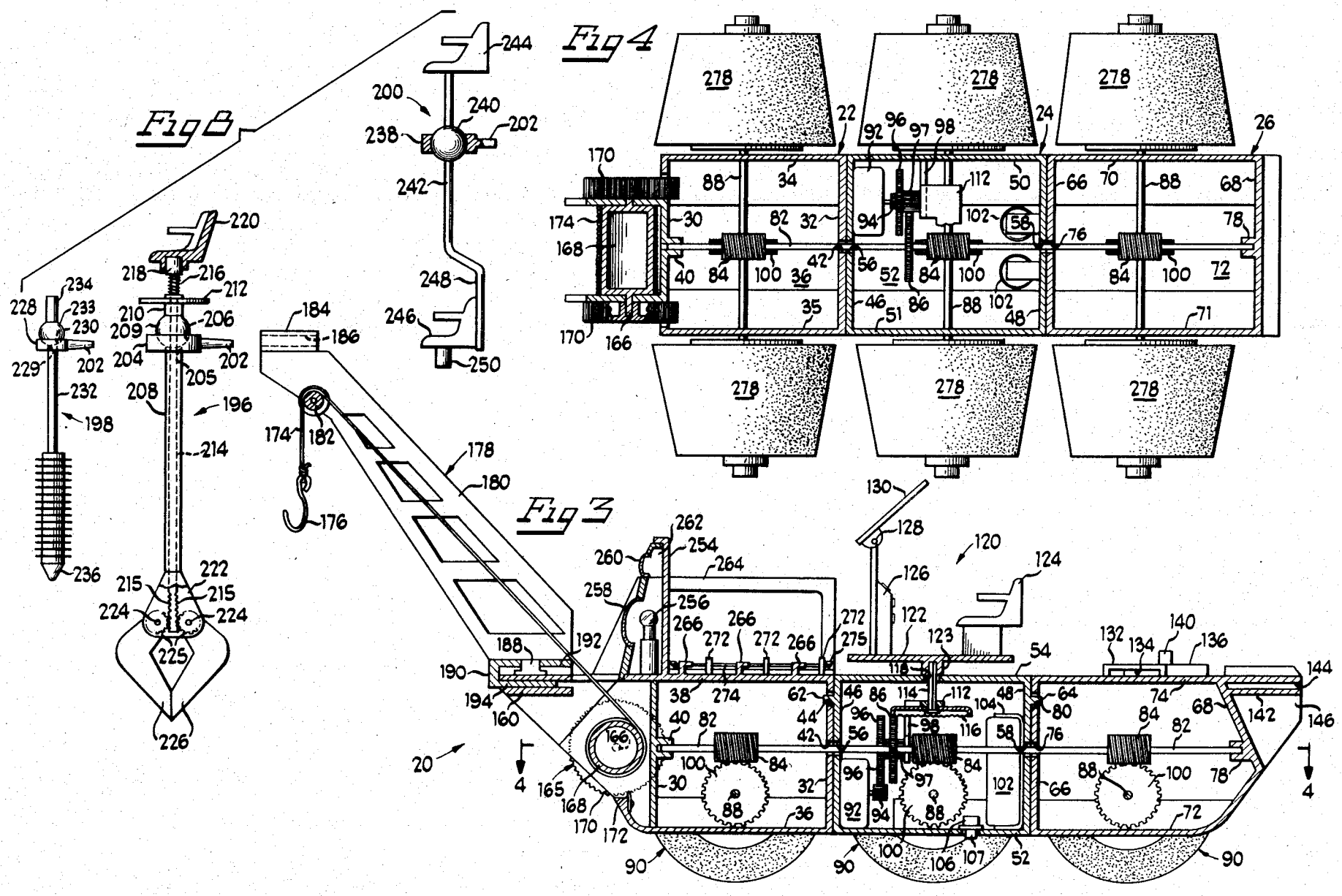
FIG. 3 is a sectional view taken generally along the line 3—3 of FIG. 2 with a crane boom accessory mounted on the vehicle.
FIG. 4 is a sectional view taken generally along the line 4—4 of FIG. 3.
FIG. 8 is an elevational view of a number of accessories mountable on the crane boom.
Figure 5:
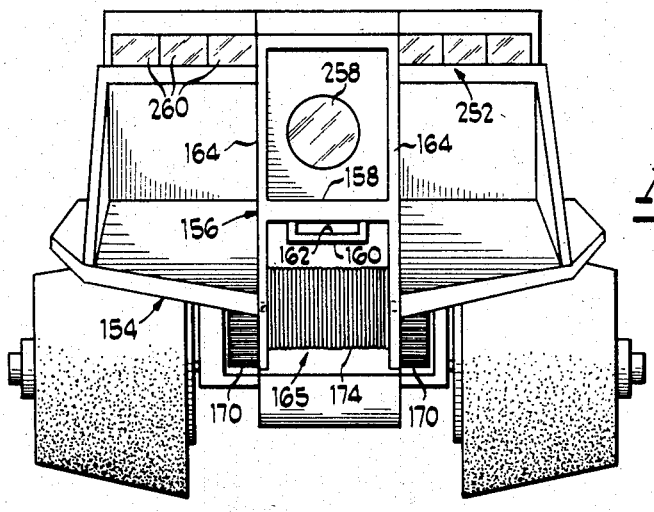
FIG. 5 is a front elevational view.
Figure 12:
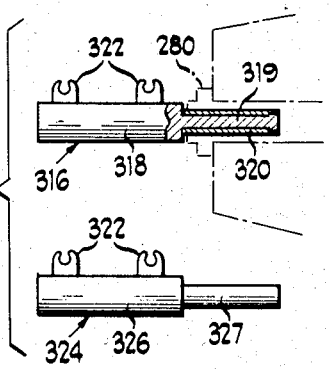
FIG. 12 is an end elevational view of two accessories mountable on the vehicle wheel axles.
Figure 6:
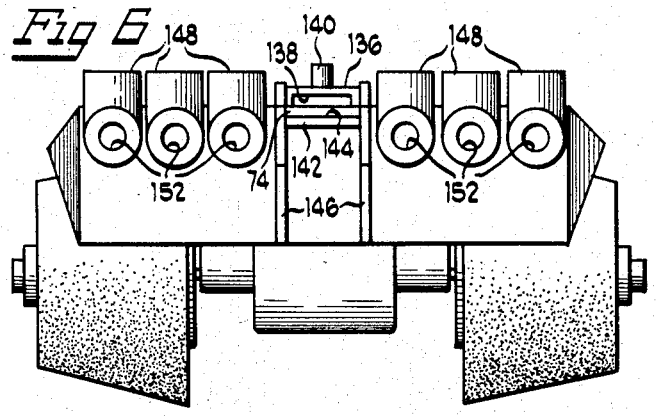
FIG. 6 is a rear elevational view.
Figure 13:
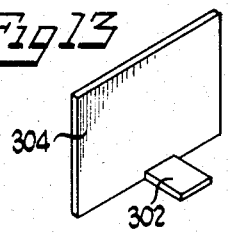
FIG. 13 is a perspective view of an accessory mountable on the vehicle deck.
Figure 7:
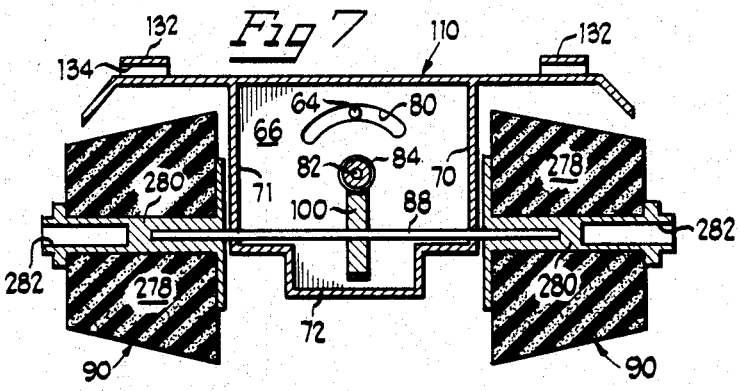
FIG. 7 is a sectional view taken generally along the line 7—7 of FIG. 2.
Figure 14:
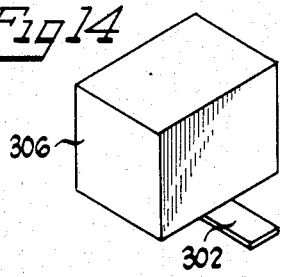
FIG. 14 is a perspective view of another accessory mountable on the vehicle deck.

As illustrated in FIG. 3, simulated radar equipment 120 may be mounted on the drive spindle. A generally circular turntable 122 with a downwardly projecting boss 123 that fits over the keyed end of the spindle 114 supports the radar equipment. On top of the turntable there is a seat 124 adapted to receive a toy figure. Spaced from the chair is an upstanding radar screen and control panel to which is pivotally mounted at 128 a triangular radar antenna 130.

Secured to the top 54 of the center section, adjacent each side, is a channel piece or cleat 132 which, together with the top, defines a rectangular slot 134. A similar pair of cleats 132 are secured to the top 74 of the rear section adjacent each side. Rear section 26 also includes a cleat or channel piece 136 that is disposed transverse to the axle 88. Together with the top 74, cleat 136 defines an elongated rectangular slot 138 that has substantially the same width and height as the slot 134. Projecting upwardly from the top of the channel piece 136 is a circular stud 140.

The exterior of the rearward wall 68 of the back section 26 has an outwardly extending rib 142 spaced below the cantilevered extension of the top 74. Rib 142 and the extension of the top 74 define yet another slot 144 which again has substantially the same height and width as the slots 134 and 138. Generally vertical fins 146 are included on either side of the cantilevered extension of the top 74 and the rib 142. Disposed along the upper rear edge of the back section 26 between the side and each fin are three "L" shaped conduits 148 each of which has a vertical bore 150 and a horizontal bore 152. Both bores are of the same diameter and approximately the same depth.

Front section 22 has a forwardly projecting prow 154 which itself has a further forwardly projecting extension 156. The upper surface 158 of the extension 156 is substantially on the same plane as the deck 110. Spaced below the top of the extension is a channel 160 defining a slot 162 of substantially the same width as the slots 134, 138 and 144. Extension 156 has side walls 164 which extend substantially vertically above and below the deck 110.

Under the prow 154 there is a winch 165. Journaled between the side walls 164, below the level of the deck 110, is a shaft 166. Mounted for rotation with the shaft 166 are a drum 168 and end thumb-wheels 170 having circumferential serrations. Projecting upwardly from a forward extension of the bottom wall 36 is a flexible pawl 172 which engages the thumb-wheel serrations to restrict the free rotation of the shaft 166 and to generate a clicking sound when the shaft is rotated. Wound around the drum 168 is a string or cable 174 with a hook 176 attached to the free end of the cable.

Crane derrick or boom 178 includes an angled elongated frame 180 that is removably attachable to the playset 20 at a number of points. A preferred attachment of the crane boom is adjacent the front or more particularly on the extension 156 of the prow 154 because of the cooperation available with the thumb-wheel operated winch 165. For use with the winch, a rotatable pully 182 is mounted adjacent the free or outwardly extending end of the frame 180. Also adjacent the outward upper projection of the frame 180 is a tubular sleeve 184 having a bore 186 that is generally horizontally disposed when the crane boom is attached to the vehicle.

The lower attachable end of the frame 180 has a downwardly projecting cylindrical pin with an upset head 188. A clip 190, which as illustrated in FIG. 3 is "C" shaped in cross-section, receives the pin 188 for rotation through an opening in the upper part 192 of the clip. Lower part 194 of the clip slides into the slot 162. Again, as is best shown in FIG. 3, the head of the pin 188 may contact the top part 158 of the extension 156. Thus, the crane boom 178 is attached to the vehicle for rotation about the axis of the pin 188.

It will be appreciated that, in addition to attachment on the prow extension 156, the crane boom 178 may be attached to the vehicle in a similar manner in the rear slot 144 or one of the slots 134 along either side of the middle and rear sections 24 and 26, respectively. Although the thumb-wheel operated winch is not available for use with the crane when the boom is mounted on the vehicle in the other positions, a separate hook and cable may be used. In whatever slot the crane boom is attached to the vehicle, accessories such as the claw 196, core sample 198, or high-low gimbal seat 200 may be attached. Each of these accessories includes a pin 202 that fits into the bore 186 of the sleeve 184 on the free end of the crane boom.

In the case of the claw 196, the pin 202 projects from a ring 204 having a generally centrally disposed opening extending through the ring and a concentric concave depression 206 in the upper face. Tubular shaft 208 passes through the opening 205 and is suspended below the ring by a substantially spherical ball 209 that is seated in the concave recess 206. Opening 205 is sufficiently larger than the outside diameter of shaft 208 to permit swiveling movement of the ball 209 in the concave recess 206. Spaced above the ball 209 by an upper extension 210 of the tubular shaft 208 is a disk 212.

Extending through the shaft 208, ball 209, extension 210 and disk 212 is a rod 214 having gear racks 215 on opposed sides at the lower end. The upper end of the rod 214 projects above the disk 212 with a coil spring 216 captured on the projecting upper end by a cylindrical cap 218. A seat 220 adapted to receive an articulated play figure is frictionally mountable on top of the cap 218. Thus, it will be appreciated that a child may depress the rod 208 against the bias of the coil spring 216 by slipping the index and middle fingers beneath the disk 212 and pressing down with the thumb upon the seat 220 itself or upon a seated figure. Seat 220 may be removed from the cap 218 and alternatively mounted upon the stud 140.

Secured to the bottom end of the tubular shaft 214 is a triangular shaped housing 222 having spaced apart plates. Adjacent the bottom of the tubular housing between the housing plates and spaced on either side of the racks 215 are shafts 224. On each of the shafts 224 is a combined gear segment 225 and claw finger 226 mounted for pivotal movement. Each of the gear segments 225 engage a rack 215 so that when the rod 214 is depressed from the position shown in FIG. 8, the racks will rotate the gear segments 225 causing the claw fingers 226 to open.

Core sampling auger 198 has a ring 228 similar to the ring 204 but somewhat smaller. A bore 229 extends through the ring 228 and there is a concave recess 230 in the upper face of the ring. The auger includes a shaft 232 that is gimbaled in the ring by means of a generally spherical ball 233 with a cylindrical stud 234 above the ball. At the bottom end of the shaft 232 there is a simulated drill or auger 236. The chair 220 may be frictionally mounted on the stud 234 if desired. Both the cylindrical cap 218 of the claw 196 and the cylindrical stud 234 of the auger are receivable in any of the bores 150 or 152 for storage of the accessories.

The high-low chair accessory 200 has a ring 238 from which the pin 202 projects. Ring 238 captures a ball 240 restricting vertical movement of a shaft 242 extending from the top and bottom of the mounted ball while permitting swiveling movement of the ball 240 within the ring 238. Atop the upper extension of the shaft 242 a permanently secured seat or chair 244 is adapted to receive a toy figure. A second chair 246 is secured to the offset lower end 248 of the shaft so that the chairs 244 and 246 are substantially vertically aligned along the axis of the main portion of the shaft 242. Chair 246 is also designed to receive an articulated play figure. Projecting from the bottom of the seat 246 is a cylindrical stud 250 which is seatable in the bores 150 and 152 along the rear of the vehicle for storage of the accessory.

Front section 22 is also provided with a lighted front bridge structure 252. As illustrated in the drawings, the bridge 252 is permanently attached or integrally molded with the front section 22. However, the bridge structure may be made as a removable accessory. Bridge structure 252 includes a hollow upstanding forward portion 254 which houses a light bulb, preferably a directional magnifying bulb 256, that is connected by suitable wiring (not shown) to the batteries 102 through the on/off switch 106. Substantially at the same height as the bulb 256 and positioned in front of the bulb is a circular spotlight lens 258.

Above the bulb and spotlight lens are three running lights 260 on either side of the portions of the fins 164 extending above the level of the deck 110. All six of the running lights may be formed as part of an acrylic plastic light bar 262 that is disposed above the bulb 256. The bar is covered with paint or another opaque coating except in the areas of the running lights 260 and a small area in a face of the bar disposed above the bulb 256. Bridge structure 252 also includes side frames 264 extending rearwardly from the part 254.

On the top of the front section 22 there are a series of supports for releasably securing the feet of play figures in a standing position. Three spaced apart, substantially parallel, inverted "L" shaped, brackets 266 are attached to the top 38. Adjacent each of the sides 34 and 35 are a pair of spaced apart short, right-angle pieces 268 which slidably trap a ladder-like frame 270 for fore-and-aft reciprocal movement. Frame 270 includes three spaced apart, substantially parallel, braces 272. A rubberband 274 along each side of the frame 270 is secured at one end to a lug 275 on the frame and at the other end to a lug 276 attached to the top 38 of the front section.

Frame 270 and each of the braces 272 is biased forward by the rubberbands toward a respective one of the brackets 266. As will perhaps be appreciated from the view in FIG. 3, the toes of a toy figure will fit under one of the brackets 266 and the brace 272 will be biased against the heel of the figure to trap the foot and maintain the figure in a standing position atop the deck 110. The rubberbands 274 provide sufficient bias to maintain the play figure in the upright position while permitting different spacing between each respective pair of a bracket 266 and brace 272 to accommodate variations in the foot size of the play figures of various manufacturers.

Each of the wheel assemblies 90 includes a large surface engaging wheel or tire 278 that is mounted for rotation on a flanged wheel hub 280 secured to the axle 88 for rotation. The outer end of the flanged hub 280 has an axial cylindrical bore 282 which is approximately the same diameter and depth as the bores 150 and 152.

Accessories such as personnel carriers 284 and 286 may be supplied for mounting in any of the horizontal bores 152 or the axle bores 282. Carrier accessory 284 may be used for the transporting of "injured" play figures and includes a lower body receiving portion 288 with an upper hinged transparent cover 289. Attached to the lower portion 288 is a bracket 290 which has a laterally projecting axle 292 concentrically mounted within a sleeve 294 permitting pivoting of the bracket about the axes of the axle 292 and sleeve 294. The sleeve 294 may be frictionally mounted within the bores 282 of any of the wheel axles, or any one of the six horizontal bores 152 along the back edge of the vehicle.

Figure 16:
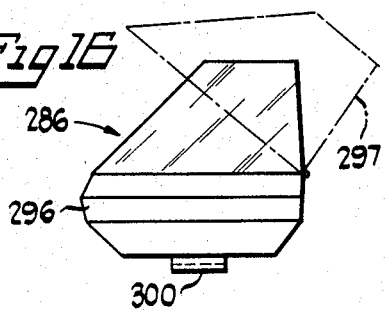
FIG. 16 is a side elevational view of the accessory shown in FIG. 15.
Figure 15:
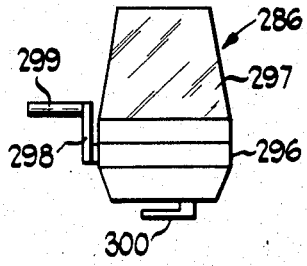
FIG. 15 is a front end elevational view of an accessory selectively mountable on the vehicle deck or the vehicle wheel axles.

Personnel carrier accessory 286 is conveniently shaped to accept figures in a seated position and has a lower seating portion 296 with an upper hinged transparent cover 297. In FIG. 16, the cover 297 is shown open in phantom. From the backside of the lower portion 296 extends a bracket 298 which has a laterally projecting pin 299 adapted for frictional mounting within any of the bores 252 and 282. On the bottom of the seating portion 296 there is an "L" shaped tongue 300 which permits alternative mounting of the accessory 286 within any of the slots 134, 144, or 162.

Additional accessories for mounting in the slots 134, 138, 144 and 162 by means of a tab or tongue 302 are also provided. Examples of such additional accessories are armor plates 304 and equipment boxes 306. A support arm 308 permits mounting of an accessory such as 284 having only a cylindrical mounting pin or sleeve to the vehicle using any of the slots 134, 144, or 162. Arm 308 has an upper lateral tongue or tab 310 that fits into one of the slots and a downwardly extending generally vertical portion 312. Extending laterally from the vertical portion is a tubular stub shaft 313 with a bore 314 of the same general diameter and depth as the bores 152 and 282.

Yet another accessory that is insertable into one of the bores, preferably one of the axle bores 282, is a figure supporting bar 316. Cylindrical bar 318 has a smaller diameter extending shaft 319 that is captured for rotation in a sleeve 320. A pair of spaced apart "U" shaped clamps 322 receive the hands of a play figure. Sleeve 320 is frictionally mounted within a bore 282 and as the wheel and axle assembly rotates, the figure is carried along in a static position alongside the rotating wheel.

Rotatable support 324 provides for dynamic mounting of a play figure in one of the wheel axle bores 282. The support 324 has a bar 326 with a smaller diameter extension 327, the extension being frictionally mountable directly within one of the bores 282. Again, a pair of spaced apart play figure hand supporting clamps are mounted on the bar 326. However, with this figure support, as opposed to support 316, the figure is rotated about the axes of the support and the wheel axle.

If desired, additional accessories mountable in either the slot or bores may also be provided. For example, an angled ramp (not shown) could be provided for attachment at the back end of the vehicle by means of a tab or tongue such as 302 mountable in either slot 138 or 144 to permit a separate smaller vehicle (not shown) to be driven up onto the deck 110. In such a case, the radar equipment 120 would be removed from the spindle 114 and the additional vehicle could be transported or repaired, using the crane, on the mobile playset 20.

While a particular embodiment of the present invention has been shown and described with some alternatives, other changes and modifications will occur to those skilled in the art. It is intended in the following claims to cover all such changes and modifications as fall within the true spirit and scope of the present invention.

What is claimed as new and desired to be secured by Letters Patent is:

1. A toy motor driven mobile playset comprising:
a single motor powering an elongated shaft;
motor driven surface engaging wheel and axle assemblies in engagement with the elongated shaft;
a chassis supported above the wheel and axle assemblies;
the chassis comprising articulated sections;
each of the articulated sections having a driven wheel and axle assembly;
each of the sections being permitted to swivel about the axis of the elongated shaft;
an essentially flat deck on the chassis; and
means on the deck for removably mounting accessories.

2. The toy mobile playset of claim 1 in which the swiveling movement of each section with respect to an adjoining section is limited by stop means.

3. The toy mobile playset of claim 1 including an accessory removably mountable on the deck for rotation about an axis transverse to the plane of the deck.

4. The toy mobile playset of claim 1 in which the mounting means include slots.

5. The toy mobile playset of claim 1 in which the mounting means include bores.

6. The toy mobile playset of claim 5 including:
bores carried adjacent the ends of at least some of the axles; and
toy figures supporting bars mountable in the bores.

7. The toy mobile playset of claim 6 in which the bars each have "U" shaped clamps for receiving the hands of a toy figure.

8. The toy mobile playset of claim 1 including a removably mountable crane boom accessory.

9. The toy mobile playset of claim 8 in which the crane includes a cable and manually powered winch.

10. The toy mobile playset of claim 1 including means on the deck for retaining toy figure in upstanding positions by biased clamping of the feet of the figures.

11. The toy mobile playset of claim 10 in which the figure retention means include a toe bracket and a heel brace that are relatively movable and are biased toward each other.

12. The toy mobile playset of claim 11 including a plurality of such brackets and braces.

13. The toy mobile playset of claim 1 including:
a lighted bridge structure with a single battery powered bulb;
a spotlight lens mounted in the bridge structure at approximately the level of the light bulb;
a light bar disposed above the bulb; and
the bar being divided into a plurality of head lamps atop the bridge structure.

14. A toy motor driven mobile playset comprising:
motor driven surface engaging wheel and axle assemblies;
a chassis supported above the wheel and axle assemblies;
an essentially flat deck on the chassis;
means on the deck for removably mounting accessories;
a removably mountable crane boom and claw accessory;
a gimbal mounted elongated tubular shaft attachable to the boom;
an elongated rod carried for movement within the tubular shaft and biased upwardly;
the rod having a lower end projecting below the tubular shaft;
opposed gear racks adjacent the lower end of the rod;
a pair of claw fingers and gears mounted for pivotal movement about an axis substantially transverse to the elongated dimension of the tubular shaft and rod;
each of the fingers having a free end abutting the free end of the other fingers; and
each of the gears being in engagement with one of the racks such that depression of the rod in opposition to the bias force will cause the free ends of the fingers to move apart.

15. The toy mobile playset of claim 14 including a seat for a play figure removably mountable atop the rod.

16. A toy motor driven mobile playset comprising:

motor driven surface engaging wheels and axle assemblies;

a chassis supported above the wheel and axle assemblies;

bores carried adjacent the ends of at least some of the axles;

accessories removeably mountable in the bores; and the accessories including toy figure supporting bars each having a pair of spaced apart "U" shaped clamps to receive the hands of a toy figure.

17. The toy mobile playset of claim 16 in which the accessories include means that are removably mountable in the bores permitting pivoting of the accessory relative to the axles.

18. The toy mobile playset of claim 16 in which the accessories include enclosures with openable hinged covers for carrying toy figures.

* * * * *